United States Patent [19]

Hartman

[11] Patent Number: 5,044,547

[45] Date of Patent: Sep. 3, 1991

[54] DECORATIVE TRAY OR TRAY COVER

[75] Inventor: Andrew F. Hartman, Eindhoven, Netherlands

[73] Assignee: Timothy A. Canning, Raleigh, N.C.

[21] Appl. No.: 499,766

[22] Filed: Mar. 27, 1990

[51] Int. Cl.[5] ..... B65D 5/62

[52] U.S. Cl. ..... 229/40; 229/87.19; 229/175; 229/923; 493/111

[58] Field of Search ..... 229/40, 175, 923, 87.18, 229/87.19; 493/100, 111-113, 386

[56] References Cited

U.S. PATENT DOCUMENTS

| | | | |
|---|---|---|---|
| 1,402,259 | 1/1922 | Smith | 229/40 |
| 1,758,511 | 5/1930 | Gross | 229/923 |
| 2,697,546 | 12/1954 | Bergstein | 229/40 |
| 2,769,588 | 11/1956 | Beck | 229/40 |
| 2,932,439 | 4/1960 | Sparling | 229/923 |
| 3,499,598 | 3/1970 | Foley, Jr. et al. | 229/923 |
| 3,851,815 | 12/1974 | Desmond et al. | 229/87.18 |
| 4,005,814 | 2/1977 | Foster | 229/87.19 |
| 4,244,508 | 1/1981 | Schulman | 229/923 |
| 4,765,535 | 8/1988 | Michetti | 229/40 |
| 4,795,084 | 1/1989 | Hartman | 229/125 |

*Primary Examiner*—Gary E. Elkins
*Attorney, Agent, or Firm*—Rodgers & Rodgers

[57] ABSTRACT

A decorative tray or tray cover is formed from a scored paperboard blank having main, side and end panels and base flaps arranged for simultaneous manipulation with an unscored paper blank having a decorative outer surface and being disposed in coincidence with the paperboard blank and with its inner surface in face contacting relation therewith to provide tray or tray cover which is attractive in appearance and which requires no adhesive of any kind.

13 Claims, 3 Drawing Sheets

DECORATIVE TRAY OR TRAY COVER

TECHNICAL FIELD

This invention relates to tray or tray covers formed of paperboard which is scored to provide interlocking means at its corners and which is provided with a decorative outer overwrap disposed in flat face contacting relation with the paperboard blank.

BACKGROUND ART

U.S. Pat. No. 4,795,084 issued Jan. 3, 1989 and owned by the assignee of this invention discloses a tray or tray corner formed of a scored paperboard blank. No provision is made in this arrangement for applying a decorative unscored paper cover to the outer surface of the paperboard blank.

SUMMARY OF THE INVENTION

According to this invention in one form, a scored paperboard box blank is shipped to the retailer by the box manufacturer in collapsed form along with an unscored decorative blank. The scored paperboard blank is manipulated by the retailer while in flat face contacting relation with the paper blank the paperboard blank so as to expose the decorative outer surface of the unscored paper blank as the tray is formed without the use of adhesive of any kind. By this means an economical and attractive box is provided.

A tray or cover formed according to one form of this invention utilizes a paperboard blank which is scored to define various panel elements including locking devices together with an unscored paper blank having outer edges which are disposed in coincidental relation with the outer edges of the paperboard blank and the outer surface of the paper blank includes a decorative design for enhancing the appearance of the finished container. Both the paperboard blank and the paper blank are disposed in flat face contacting relation to each other and are simultaneously manipulated into set up condition. Various side and end panels are simultaneously manipulated into set up condition and locking means formed on the paperboard blank at the end edges of the side walls serve to interlock the paperboard side walls and simultaneously to secure the outer decorative paper blank in locked position about the paperboard box structure.

BEST MODE OF CARRYING OUT THE INVENTION

Figure 1:
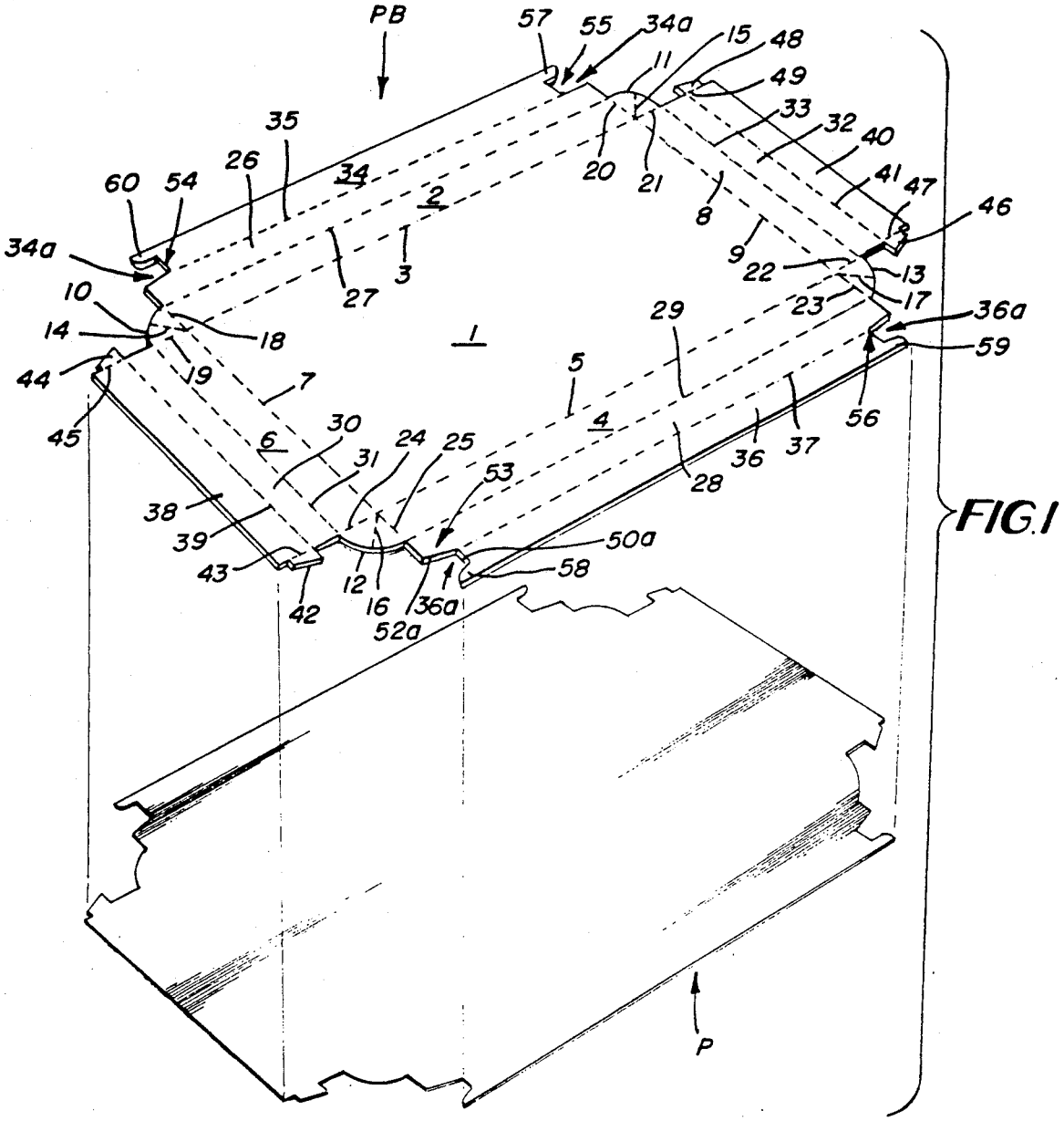
FIG. 1 is a plan view of a scored paperboard blank disposed in vertically aligned relation with a lower unscored paper blank.
Figure 3:
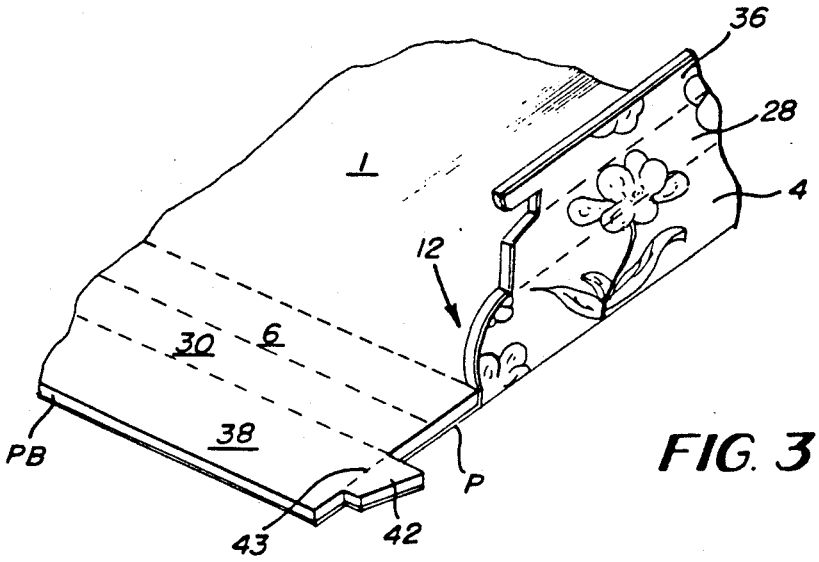
FIG. 3 shows an initial folding operation whereby the paperboard and paper blanks are manipulated so that their side panels are in vertical relation with respect to their main bottom panel.

With reference primarily to FIG. 1, a paperboard blank is designated generally at PB and a paper blank is designated at P. The numeral 1 designates the main quadrilateral panel of blank PB having right angle corners. Outer side panel 2 is foldably joined to main panel 1 along fold line 3 while outer side panel 4 is foldably joined to main panel 1 along fold line 5. Outer end panel 6 is foldably joined to main panel 1 along a fold line 7 and outer end panel 8 is foldably joined to main panel 1 along fold line 9.

The outer side panels are interconnected by web structures 10, 11, 12 and 13 which are disposed at the four corners of main panel 1. Each web structure is collapsible along a fold line such as indicated at 14, 15, 16 and 17. Web 10 is foldably joined to outer side panel 2 along fold line 18 and to the adjacent end of outer side panel 6 along fold line 19. Web 11 is foldably joined to outer side panel 2 along fold line 20 and to outer side panel 8 along fold line 21 while web 13 is foldably joined along fold line 22 to the end of outer side panel 8 and along fold line 23 to the end of outer side panel 4. Web 12 is foldably joined to outer side panel 6 along fold line 24 and to outer side panel 4 along fold line 25.

Outer side panels 2, 4, 6 and 8 are reinforced. For example, inner side panel 26 is foldably joined to outer side panel 2 along a fold line 27 while inner side panel 28 is foldably joined to outer side panel 4 along fold line 29. In like fashion, inner side panel 30 is foldably joined to outer side panel 6, a long fold line 31 and inner side panel 32 is foldably joined to outer side panel 8 along fold line 33.

When the tray is assembled, inner side panels 26, 28, 30 and 32 are disposed in flat face contacting relation with the outer side panels 2, 4, 6 and 8 respectively.

Base flap 34 is foldably joined to inner side panel 26 along fold line 35 while base panel 36 is foldably joined to inner side panel 28 along fold line 37. Base flap 38 is foldably joined to inner side panel 30 along fold line 39 and base flap 40 is foldably joined to inner side panel 32 along fold line 41. Base flaps 34, 36, 38 and 40 are disposed in flat face contacting relation with main panel 1 when the tray is set up.

Figure 2:
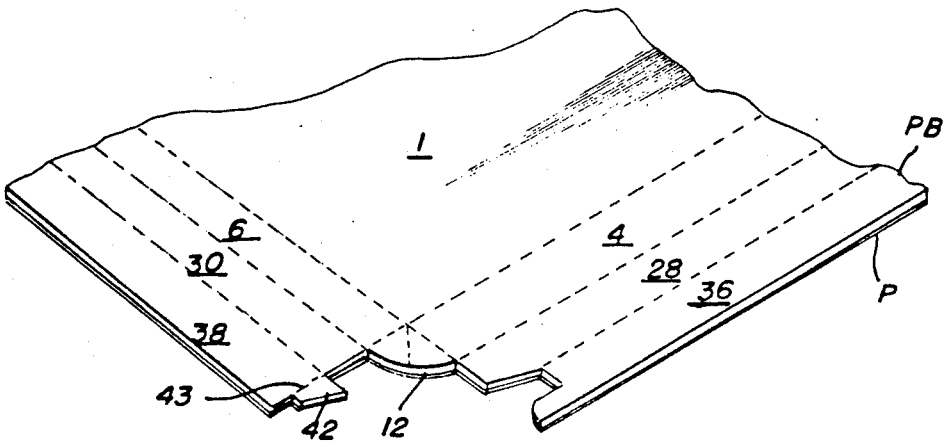
FIG. 2 is a fragmentary view of a composite blank of a corner of a composite blank formed from the two structures shown in FIG. 1.
Figure 2A:
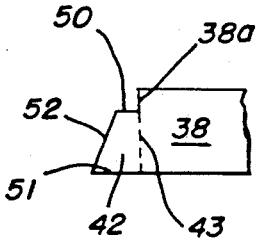
FIG. 2*a* is an enlarged fragmentary view of a locking tab and the panel to which it is adjacent.
Figure 4:
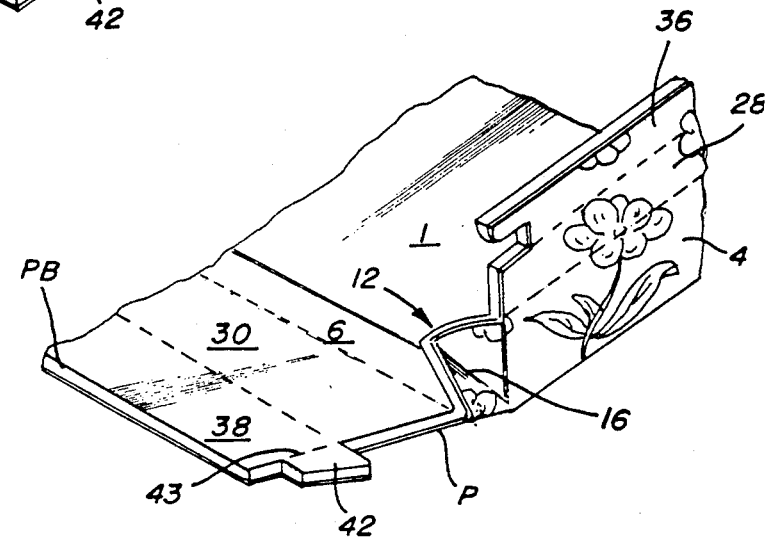
FIG. 4 is a view similar to FIG. 3 but shows the initial folding of web structure which interconnects adjacent ends of the carton side panels and end panels.
Figure 5:
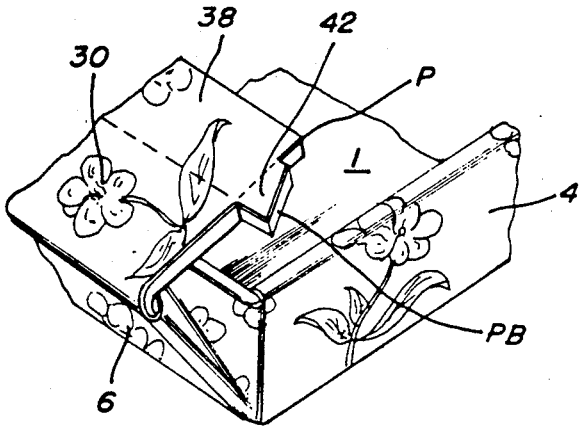
FIG. 5 is a view similar to FIG. 4 but simply shows a later stage in the folding operation.

For locking the elements in set up condition, locking tab 42 is foldably joined along fold line 43 to one end of base flap 38 and a similar locking tab 44 is foldably joined to the opposite end of base flap 38 along fold line 45. The edge 50 of locking tab 42 is spaced from the outer edge of base panel 38. At the other end of the blank, locking tab 46 is foldably joined to base flap 40 along fold line 47 and locking tab 48 is foldably joined to base flap 40 along fold line 49. All of the locking tabs are of identical construction. It is obvious from an inspection of these tabs that they are of trapezoidal configuration. As is clear from FIG. 2*a*, tab 42, for example, is defined by its fold line 43, its short parallel edge 50 and its longer parallel edge 51 together with the angularly disposed edge 52. Edges 50, 51 and 52 are exposed and free of attachment to any other element.

For cooperating with the locking tabs, each end of each inner side panel 26 and 28 is cutaway at its outer corners to define a cutaway area partially indicated by edges of the cutout section. For example the short parallel edge 50 of locking tab 42 engages the short transverse edge or cut line 50*a* of the cutout corner portion of inner side panel 28. Edge 38*a* of panel 38 engages inner panel 28 adjacent fold line 37 and holds the inner side panel 28 in a normal position relative to main panel 1 and prevents collapse of the inner side panel 28. In like fashion, the cut edge 52*a* of cutaway area 53 abuts and coincides with the edge 52 of the locking tab 42. All of the locking tabs are configured in a manner identical to locking tab 42 and cooperation of locking tabs 44, 46 and 48 with associated cutaway areas 54, 56 and 55 is identical to that of locking tab 42 and its cutaway area 53.

Extending tabs 60 and 57 are formed at the outer corners of base flap 34 while identical extending tabs 58 and 59 are formed at the outer corners of base flap 36.

The cutaway end portions of the base panels 34 and 36 which are designated by the arrows 34*a* and 36*a* serve to facilitate locking and holding action of locking tabs 44, 48, 42 and 46. For example and with reference to locking tab 42, cutaway area 36*a* affords space into which the lower edge 43 of locking tab 42 is pressed. The memory or "fight" along fold line 43 causes tab 42 to press against the inner surface of outer side panel 4 and also causes edge 52 to engage securely the edge 52*a* while locking tab 42 snaps into secure locking position and may overlap edge 52*a*.

Figure 7:
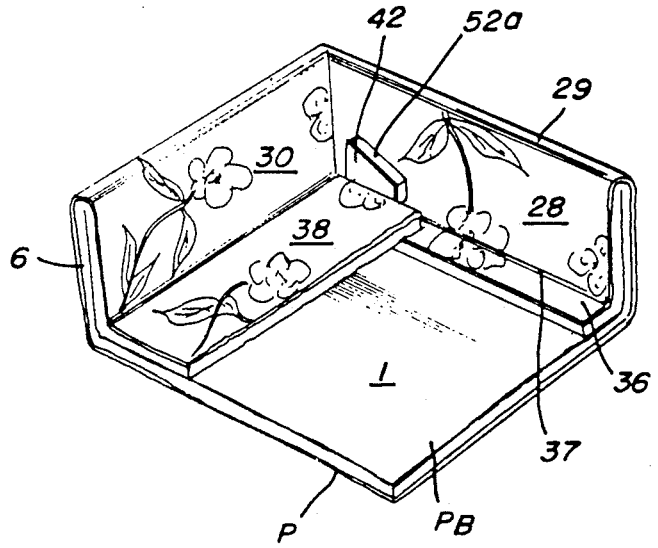
FIG. 7 is a view of a corner of the structure as seen in FIG. 6 when fully completed and set up.
Figure 8:
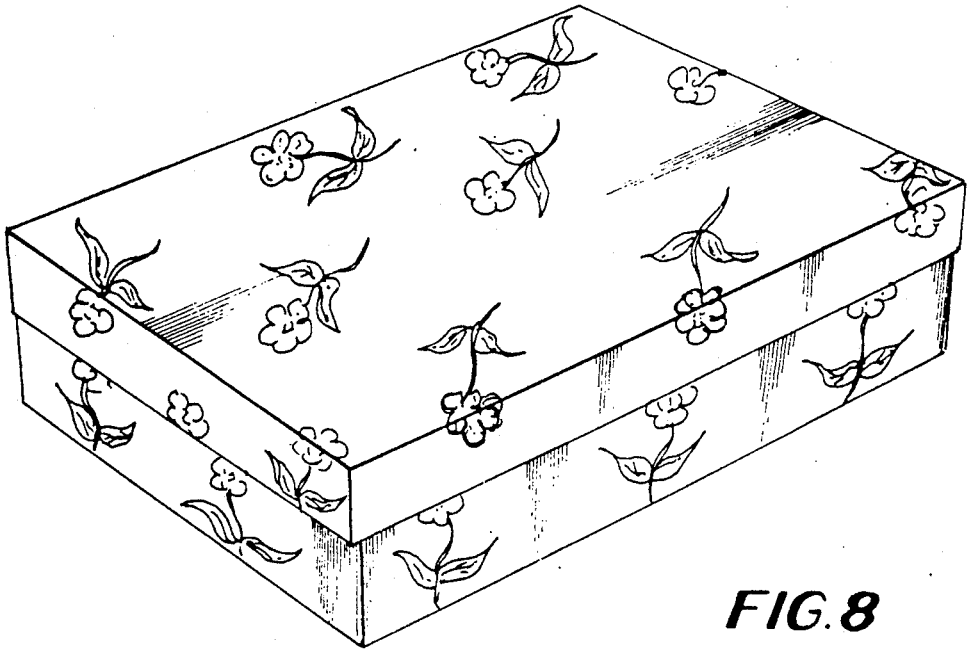
FIG. 8 simply is a perspective view of a completed carton tray and its lid.

In order to set up the carton so that each corner appears from the inside as shown in FIG. 7, the inner side panel 28 is folded inwardly along fold line 29 and the outer side panel 4 together with associated structure is folded along the fold line 5 into vertical position so as to cause the base flap 36 to lie in flat face contacting relation against the main panel 1. After panel 28 is in vertical position, inner side panel 30 is folded along fold line 31 into flat face contacting relation with the outer side panel 6 and outer side panel 6 is folded into perpendicular relation to main panel 1 which folding operation causes the base flap 38 to fall into flat face contacting relation with the main panel 1. During these folding operations, the web 12 collapses inwardly on fold line 16 and is captured between the adjacent ends of outer side panel 6 and inner side panel 30. During this folding operation, the locking tab 42 swings along its fold line 43 into a perpendicular position relative to main panel 1 and the locking edge 52 of locking tab 42 comes into abutting or overlapping engagement with the edge 52*a* of cutaway area 53 and the set up corner appears as shown from inside in FIG. 7. FIG. 8 shows a tray and associated lid formed according to this invention.

Figure 6:
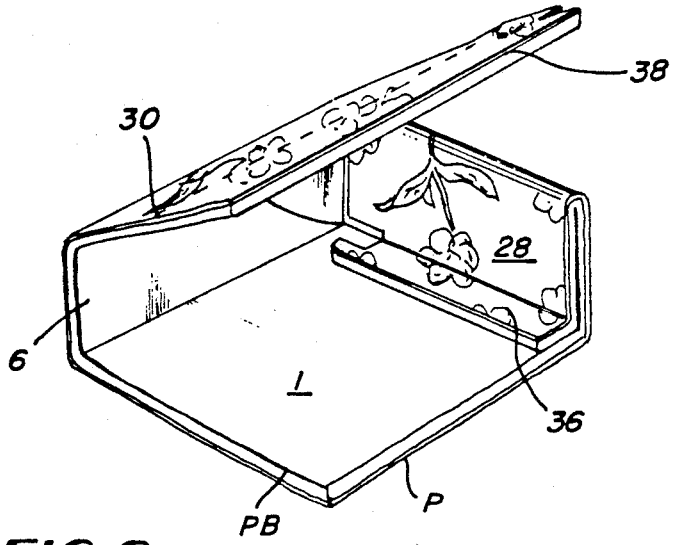
FIG. 6 is a view similar to FIG. 5 but which is taken from the inside thereof.

FIG. 6 shows the folding of inner side panel 28 and of base flap 36 after completion of their folding operation and shows outer side panel 6, inner side panel 30 and base flap 38 during an intermediate stage of folding from the flat position represented in FIG. 1 to the set up condition shown in FIG. 7. FIG. 8 shows a tray and associated lid formed according to this invention.

It is obvious that a tray or tray cover may be formed according to the invention. Minor changes in dimensions may be made to accommodate proper interfitting of the two components as is obvious.

From the foregoing discussion taken in conjunction with the drawings, it is clear that by the invention a sturdy attractive tray or tray cover is provided which requires no glue and which therefore is suitable for use at the retail level to package various items sold to the public and for use in may industrial applications.

It is also apparent that a tray or tray lid which is of substantial mechanical strength and which because of its paper outer wrap is attractive in appearance is provided. Furthermore it is also apparent that this result is accomplished without the use of glue or adhesive of any kind thus avoiding the possibility that the carton might lead to spillage of glue and the attendant difficulties when a retailer would set up the structure using glue rather than using the principles according to this invention.

In addition, the "memory" of the board causes the board to tend to snap back into its original flat condition when folded. For example, scores such as 5, 29 and 37 tend to cause the sides of the tray or lid to bow out because of memory and impede erection of the tray. To overcome this condition, the erected sides are overfolded. For example, wall panel such as 4 is folded toward main wall 1 through an angle greater than 90 degrees and inner wall panel 28 is folded toward base panel 36 through an angle greater than 90 degrees. Thereafter panels 4 and 28 are folded back to vertical positions or normal relations to main panel 1.

When loose paper P and blank PB cooperate together, overfold provides another advantage. It creases paper P and holds it in place in the interior of the box. Overfold makes a crease along fold line 37 and holds paper wrap in place inside the box down the full length of the score 37. With paper and board working together, overfolding overcomes memory and sets a crease into the paper. This cooperation and process make the interior look finished and complete in addition to having the side walls vertical, eliminating outward bowing.

Paper follows board in all folds and scores except at the web corners. Because of the stiffness in the board, the web corner requires only a light tough to start the paper fold. After this touch, the web corner folds properly. Without it the web may fold the wrong way.

This is not the case with paper. Paper requires an assist to fold into the web. Paper does not have the stiffness to be able to fold properly into the web. If the assist does not occur, the paper will protrude out of the web, making an unattractive looking corner.

In addition, when the web of board PB is covered with paper, and the web corner is set properly, the paper is trapped between the two folds of boards holding the paper neatly in place. This cooperation between the paper and board is unique and gives the box a pleasing, finished appearance.

I claim:

1. A tray or tray lid comprising a scored paperboard blank and a separate paper blank of wrapping material of similar configuration to said paperboard blank and arranged with its inner surface in flat face contacting relation with the outer surface of said paperboard blank and with its edges in substantial coincidence with the edges of said paperboard blank, said paperboard blank and corresponding parts of said unscored paper blank including main panels of quadrilateral configuration with right angle corners, outer side panels foldably joined to opposite side edges of said main panels and disposed in substantially perpendicular relation to said main panels respectively, outer end panels foldably joined to opposite end edges of said main panels and disposed in substantially perpendicular relation to said main panels respectively, locking means including web structure securing the adjacent ends of said outer side and end panels of said scored paperboard blank and of said paper blank together at each corner of the tray or tray lid and constituting means for holding the paper blank in contact with the paperboard blank whereby mechanical strength and durability are imparted to the tray or tray lid by the scored paperboard and an attractive appearance is derived from the outer surface of the paper blank.

2. A tray or tray lid according to claim 1 wherein inner paperboard panels are foldably joined to edges of said outer side and end paperboard panels which are remote from said main panel, web structure of paperboard foldably joined to the adjacent ends of said outer side and end panels at each corner of said main panel, said web structures being collapsed at each corner of said main panel and being gripped in collapsed condition between the adjacent ends of said outer end panels and said inner end panels, and the areas of said paper blank which coincide with each of said web structures of said paperboard blank being collapsed and disposed between collapsed portions of each of said collapsed paperboard web structures whereby friction between each of said paperboard web structures and the corresponding parts of said paper blank secure said paper blank in a position of covering relation to the outer surfaces of said paperboard blank and constituting means of holding the paper blank to the paperboard blank when the blanks are set up.

3. A tray or tray lid according to claim 1 wherein inner side and end panels are disposed in flat face contacting relation with and are foldably joined respectively to the edges of said outer side and end panels which are remote from said main panel, a base flap is foldably joined to the edge of each of said inner side and end panels which is remote from the fold line between each of said inner side panels and the associated outer side panel, said base flaps being disposed in flat face contacting relation with said main panel, a locking tab is foldably joined to each end edge of the ones of said base flaps which are foldably joined to said inner end panels, adjoining areas of both ends of said inner side walls and of said base flaps which are foldably joined to said inner side walls being cutaway to define locking cavities for receiving and securing adjacent locking tabs after said locking tabs are folded into perpendicular relation to their associated base flaps and the areas of said paper blank which coincide with said locking tabs being folded into perpendicular relation to their associated base flaps and are thereby anchored in an adjacent cavity so as to hold the associated paperboard and paper in secure coincidental positions with respect to each other.

4. A tray or tray lid comprising a scored paperboard blank and a separate unscored paper blank of similar configuration to said paperboard blank and arranged with its inner surface in flat face contacting relation with the outer surface of said paperboard blank and with its edges in substantial coincidence with the edges of said paperboard blank, said paper blank having a decorative outer surface, said paperboard blank including a quadrilateral main panel having side and end edges and right angle corners, a pair of outer side panels foldably joined respectively to the side edges of said main panel and disposed in perpendicular relation to said main panel, a pair of inner side panels foldably joined respectively to the edges of said outer side panels which are remote from said main panel and disposed in flat face contacting relation therewith, a pair of outer end panels foldably joined respectively to the end edges of said main panel and disposed in perpendicular relation to said main panel, a pair of inner end panels foldably joined respectively to the edges of said outer end panels which are remote from said main panel and disposed in generally perpendicular relation to said main panel, a collapsible web structure foldably joined to the adjacent ends of said outer side and end panels at each corner of said main panel, said web structures being collapsed at each corner of said main panel and being gripped in position between the adjacent ends of said outer end panels and said inner end panels, and the areas of said paper blank which coincide with each of said web structures being collapsed and disposed between collapsed portions of each of said collapsed web structures whereby friction between each of said web structures and the corresponding parts of said paper blank secure said paper blank in position of covering relation to the outer surfaces of said paperboard blank.

5. A tray or tray lid comprising a scored paperboard blank and a separate unscored paper blank of similar configuration to said paperboard blank and arranged with its inner surface in flat face contacting relation with the outer surface of said paperboard blank and with its edges in substantial coincidence with the edges of said paperboard blank, said paper blank having a decorative outer surface, said paperboard blank including a quadrilateral main panel having side and end edges and right angle corners, a pair of outer side panels foldably joined respectively to the side edges of said main panel and disposed in perpendicular relation to said main panel, a pair of inner side panels foldably joined respectively to the edges of said outer side panels which are remote from said main panel and disposed in flat face contacting relation therewith, a pair of outer end panels foldably joined respectively to the end edges of said main panel and disposed in perpendicular relation to said main panel, a pair of inner end panels foldably joined respectively to the edges of said outer end panels which are remote from said main panel and disposed in generally perpendicular relation to said main panel, a base flap foldably joined to the edge of each of said inner side and end panels which is adjacent said main panel, said base flaps being disposed in flat face contacting relation with said main panel, a locking tab foldably joined to each end edge of the ones of said base flaps which are foldably joined to aid inner end panels, adjoining areas of both ends of said inner side walls and of said base flaps which are foldably joined to said inner side walls being cutaway to define locking cavities for receiving and securing adjacent locking tabs after said locking tabs are folded into perpendicular relation to their associated base flaps and the areas of said paper blank which coincide with said locking tabs being folded into perpendicular relation to their associated base flaps and are thereby anchored in an adjacent cavity so as to aid in holding the associated paperboard and paper in secure coincidental positions with respect to each other.

6. A tray or tray lid according to claim 5 wherein the paperboard base flaps foldably joined to the edges of said inner side panels which are adjacent said main panel and the corresponding areas of said paper blank are held in secure flat face contacting relation with each other and with the paperboard ones of said base flaps secured in flat face contacting relation with said main panel due to the disposition of the ends of said end base flaps above the adjacent ends of said side base flaps and due to overfolding of the base flaps.

7. Corner structure for a tray or tray lid formed from a composite blank including an inner scored paperboard blank having an outer surface and a separate outer unscored paper blank having an inner surface disposed in substantially coincidental flat face contacting relation with said outer surface of said inner paperboard blank and having a decorative outer surface, said corner structure comprising a composite quadrilateral main panel with right angle corners, a pair of composite outer panels having adjacent end edges and being perpendicular to said main panel and being foldably joined respectively to edges of said composite main panel along fold lines which intersect at a corner of said main panel, a composite collapsed web structure foldably joined to adjacent end edges of said composite outer panels, a pair of composite inner panels disposed in flat face contacting relation respectively with said pair of composite outer panels and foldably joined thereto along their top edges, the collapsed web structure of said paper blank being disposed within the collapsed web structure of said paperboard blank whereby said paper blank is securely held in its corner position by friction between said paperboard web and said paper web.

8. Corner structure for a tray or tray lid formed from a composite blank including an inner scored paperboard blank having an outer surface and a separate outer unscored paper blank having an inner surface disposed in substantially coincidental flat face contacting relation with said outer surface of said inner paperboard blank and having a decorative outer surface, said corner structure comprising a composite quadrilateral main panel with right angle corners, a pair of composite outer panels having adjacent end edges and being perpendicular to said composite main panel and being foldably joined respectively to edges of said composite main panel along fold lines which intersect at a corner of said composite main panel, a pair of composite inner side panels disposed in flat face contacting relation respectively with said pair of composite outer side panels and foldably adjoined thereto along their top edges, one of said composite inner side panels being rectangular and the end edge of the outer of said composite inner side panels being configured to define the shorter parallel side of a trapezoid and another diagonal intersecting locking edge of said trapezoid, a composite base flap foldably joined respectively to each of said composite inner side panels along the edge thereof which is adjacent said composite main panel, said composite base flaps having adjacent ends and being disposed in flat face contacting relation with said composite main panel and an end portion of one of said composite base flaps overlying an end portion of the other of said composite base flaps so as to maintain the paper portion of said other composite base flap in secure face contacting relation with its associated paperboard portion, and a composite locking tab of trapezoidal configuration foldably joined to the adjacent end of said composite rectangular base flap and disposed in perpendicular relation thereto and disposed in said cutaway portion of said other composite inner panel so as to secure the paper of said trapezoid in fixed relation between said composite locking tab and the adjacent end portion of one of said composite outer panels.

9. Corner structure for a tray or tray lid formed from a composite blank including an inner scored paperboard blank having an outer surface and a separate outer unscored paper blank having an inner surface disposed in substantially coincidental flat face contacting relation with said outer surface of said inner paperboard blank and having a decorative outer surface, said corner structure comprising a composite quadrilateral main panel with right angle corners, a pair of composite outer panels having adjacent end edges and being perpendicular to said main panel and being foldably joined respectively to edges of said main panel along fold lines which intersect at a corner of said main panel, a pair of composite inner panels disposed in flat face contacting relation respectively with said pair of composite outer panels and foldably joined thereto along edges thereof remote from said main panel, a composite base flap foldably joined respectively to each of said composite inner panels along the edge thereof which is adjacent said composite main panel, said composite base flaps having adjacent overlapping ends and being disposed in flat face contacting relation with the paperboard panel of said composite main panel so that the paperboard panels of said composite base flaps are interspersed between the paperboard panel of said main composite panel and the paper panels of said composite base flaps, and the paper panels of said composite base flaps being disposed in flat face contacting relation atop the paperboard panels of the associated composite base flaps.

10. A method of forming a tray or tray lid from a scored preformed paperboard blank having outer and inner surfaces and a separate preformed unscored paper blank of similar configuration and having an inner surface and a decorative outer surface, the scores of said paperboard blank defining a main panel of quadrilateral configuration with right angle corners, outer side panels foldably joined to side edges of said main panel, outer end panels foldably joined to end edges of said main panel, inner side and end panels foldably joined respectively to edges of said outer side and end panels which edges are remote from said main panel, base flaps foldably joined to edges of said inner side and end panels which are remote from the fold lines between said outer side and end panels and said inner side and end panels, and collapsible web structure foldably joined to adjacent ends of said outer side and end panels, the method comprising placing the inner surface of said paper blank in flat face contacting relation with the outer surface of said paperboard blank and with the edges of said blanks in coincidental relation to each other, simultaneously manipulating said blanks into fully set up condition with said outer and inner side and end walls in perpendicular relation to said main panel and with said base flaps in flat face contacting relation with said main panel and with said web structure of said paperboard blank collapsed in secure face contacting relation and with corresponding parts of said paper blank securely gripped within the associated collapsed web structure so as to secure adjacent corners of the tray or lid in securely set up condition all without the application of adhesive to either of said blanks.

11. A method according to claim 10 wherein a small external force initially imparted to said web structures of said paperboard blank causes such web structures to collapse inwardly.

12. A method of forming of tray or tray lid according to claim 10 wherein said inner and said outer side and end panels are initially folded through angles substantially in excess of ninety degrees relative to said main panel and are thereafter back folded into positions of substantially perpendicular relation to said main panel.

13. A method of forming a tray or tray lid according to claim 12 wherein initially folding of said inner side and end panels through angles substantially in excess of ninety degrees forms overfolded crease lines in said paper blank which define the outer edges of said base flaps and which aid in holding said base flaps of said paper blank in secure flat face contacting relation with the corresponding base flaps of said paperboard base flaps.

* * * * *